US007753116B2

(12) United States Patent
Budney et al.

(10) Patent No.: US 7,753,116 B2
(45) Date of Patent: Jul. 13, 2010

(54) DOUBLE-ACTING JAR

(76) Inventors: David Budney, 4604 Eleniak Road, Edmonton AB (CA) T6B 2S1; Craig Budney, 4604 Eleniak Road, Edmonton AB (CA) T6B 2S1; Glenn Budney, 4604 Eleniak Road, Edmonton AB (CA) T6B 2S1

( * ) Notice: Subject to any disclaimer, the term of this patent is extended or adjusted under 35 U.S.C. 154(b) by 96 days.

(21) Appl. No.: 12/134,945

(22) Filed: Jun. 6, 2008

(65) Prior Publication Data

US 2009/0301707 A1 Dec. 10, 2009

(51) Int. Cl.
*E21B 31/113* (2006.01)

(52) U.S. Cl. ..... 166/178; 175/297

(58) Field of Classification Search ..... 166/178; 175/296–297

See application file for complete search history.

(56) References Cited

U.S. PATENT DOCUMENTS

| | | | |
|---|---|---|---|
| 2,721,056 | A | 10/1955 | Storm |
| 2,819,876 | A | 1/1958 | Ransom |
| 3,063,501 | A | 11/1962 | Britton |
| 3,239,017 | A | 3/1966 | Hazen |
| 3,285,353 | A | 11/1966 | Young |
| 3,392,795 | A | 7/1968 | Greer |
| 3,570,612 | A | 3/1971 | Slator |
| 3,606,297 | A | 9/1971 | Webb |
| 3,735,827 | A | 5/1973 | Berryman |
| 3,735,828 | A | 5/1973 | Berryman |
| 3,797,591 | A | 3/1974 | Berryman |
| 3,804,185 | A | 4/1974 | Mason |
| 3,851,717 | A | 12/1974 | Berryman |
| 3,898,815 | A | 8/1975 | Young |
| 3,949,821 | A | 4/1976 | Raugust |
| 3,955,634 | A | 5/1976 | Slator et al. |
| 3,987,858 | A | 10/1976 | Slator et al. |
| 4,023,630 | A | 5/1977 | Perkin et al. |
| 4,109,736 | A | 8/1978 | Webb et al. |
| 4,161,224 | A | 7/1979 | Hostrup |
| 4,186,807 | A | 2/1980 | Sutliff et al. |
| 4,196,782 | A | 4/1980 | Blanton |
| 4,200,158 | A | 4/1980 | Perkins |
| 4,210,214 | A | 7/1980 | Blanton |
| 4,331,006 | A | 5/1982 | Bishop |
| 4,439,167 | A | 3/1984 | Bishop et al. |

(Continued)

OTHER PUBLICATIONS

"Dual Action Mechanical Flow-Thru Jar", National Oilwell Varco [online], 2007, http://www.nov.com/productDisplay.aspx?id=1892.

(Continued)

*Primary Examiner*—Giovanna C Wright
(74) *Attorney, Agent, or Firm*—Frank J. Dykas; Stephen M. Nipper; Dykas, Shaver & Nipper, LLP

(57) ABSTRACT

A double-acting jar comprises an inner mandrel and an outer housing. The inner mandrel is disposed telescopically within the outer housing to define a fluid chamber in between. There is an uphole restriction and a downhole restriction spaced from one another within the fluid chamber. An uphole valve is disposed within the fluid chamber, the uphole valve having a first seating surface engageable with an uphole facing sealing shoulder in the fluid chamber. There is a downhole valve disposed within the fluid chamber, the downhole valve having a second seating surface engageable with a downhole facing sealing shoulder in the fluid chamber.

31 Claims, 9 Drawing Sheets

U.S. PATENT DOCUMENTS 4,511,007 A 4/1985 Jung et al.
4,566,546 A 1/1986 Evans
4,658,917 A 4/1987 Ring
4,662,460 A 5/1987 Loeb et al.
4,844,183 A 7/1989 Evans
4,846,273 A 7/1989 Anderson et al.
4,865,125 A 9/1989 De Cuir
5,007,479 A 4/1991 Pleasants et al.
5,033,557 A 7/1991 Askew
5,066,060 A 11/1991 Cooksey et al.
5,069,282 A 12/1991 Taylor
5,086,853 A 2/1992 Evans
5,123,493 A * 6/1992 Wenzel ..... 175/297
5,174,393 A 12/1992 Roberts et al.
5,232,060 A 8/1993 Evans
5,425,430 A 6/1995 Roberts
5,431,221 A 7/1995 Roberts et al.
5,447,196 A 9/1995 Roberts
5,584,353 A 12/1996 Chancey et al.
5,647,446 A * 7/1997 Wenzel ..... 175/297
5,906,239 A 5/1999 Oettli
6,202,767 B1 3/2001 Friis

OTHER PUBLICATIONS

"Double-Acting Hydraulic/Mechanical Drilling Jar", National Oilwell Varco, 2007.

* cited by examiner

DOUBLE-ACTING JAR

TECHNICAL FIELD

This apparatus relates to double-acting jars, in particular to double-acting jars that are actuatable to deliver repetitive up or down jars to a tubing string.

BACKGROUND

Jars are used in the oilfield industry to deliver jarring blows to a tubing string in order to free a stuck section of pipe. Jars are also used in fishing operations, in order to free any object stuck in a downhole well. Double-acting jars are jars that are capable of delivering an upjar or a downjar to a tubing string. U.S. Pat. No. 5,906,239, describes a double-acting jarring tool that affords a user the option of delivering successive upjars, or successive downjars, and is complex.

SUMMARY

A double-acting jar is disclosed comprising an inner mandrel and an outer housing. The inner mandrel is at least partially disposed telescopically within the outer housing to define a fluid chamber between the inner mandrel and the outer housing, the fluid chamber containing fluid and being sealed at an uphole end and at a downhole end. An uphole restriction and a downhole restriction are spaced from one another within the fluid chamber and spaced from the uphole end and from the downhole end. An uphole valve is disposed within the fluid chamber. The uphole valve has a first seating surface engageable with an uphole facing sealing shoulder in the fluid chamber to seat the uphole valve when the upper restriction slides relatively downward over at least an initial portion of the uphole valve. The uphole valve has a first exterior surface that fits with close tolerance within the uphole restriction over at least a portion of the first exterior surface. A first bypass, defined by at least one of the uphole valve, the outer housing, and the inner mandrel, is exposed when the first seating surface unseats from the uphole facing sealing shoulder. A downhole valve is disposed within the fluid chamber, the downhole valve having a second seating surface engageable with a downhole facing sealing shoulder in the fluid chamber to seat the downhole valve when the downhole restriction slides relatively upward over at least an initial portion of the downhole valve. The downhole valve has a second exterior surface that fits with close tolerance within the downhole restriction over at least a portion of the second exterior surface. A second bypass, defined by at least one of the downhole valve, the outer housing, and the inner mandrel, is exposed when the second seating surface unseats from the downhole facing sealing shoulder. First jarring surfaces are on the inner mandrel and outer housing respectively for jarring contact with each other during a jar in a first direction. Second jarring surfaces are on the inner mandrel and outer housing respectively for jarring contact with each other during a jar in a second direction. The uphole restriction and downhole restriction are separated such that when the downhole restriction slides relatively upward over the initial portion of the downhole valve to seat the downhole valve, at least a portion of the uphole restriction extends upwardly beyond a downhole end of the uphole valve sufficient to allow a jar in the first direction to be carried out. In addition, when the uphole restriction slides relatively downward over the initial portion of the uphole valve to seat the uphole valve, at least a portion of the downhole restriction extends downwardly beyond an uphole end of the downhole valve sufficient to allow a jar in the second direction to be carried out.

A double-acting jar is also disclosed comprising an inner mandrel and an outer housing. The inner mandrel is at least partially disposed telescopically within the outer housing to define a fluid chamber between the inner mandrel and the outer housing, the fluid chamber containing fluid and being sealed at an uphole end and at a downhole end. An uphole restriction and a downhole restriction are spaced from one another within the fluid chamber and spaced from the uphole end and from the downhole end. An uphole valve is disposed within the fluid chamber, the uphole valve having a first seating surface engageable with a downhole facing sealing shoulder in the fluid chamber to seat the uphole valve when the upper restriction slides relatively upward over at least an initial portion of the uphole valve. The uphole valve has a first exterior surface that fits with close tolerance within the uphole restriction over at least a portion of the first exterior surface. A first bypass, defined by at least one of the uphole valve, the outer housing, and the inner mandrel, is exposed when the first seating surface unseats from the downhole facing sealing shoulder. A downhole valve is disposed within the fluid chamber, the downhole valve having a second seating surface engageable with an uphole facing sealing shoulder in the fluid chamber to seat the downhole valve when the downhole restriction slides relatively downward over at least an initial portion of the downhole valve. The downhole valve has a second exterior surface that fits with close tolerance within the downhole restriction over at least a portion of the second exterior surface. A second bypass, defined by at least one of the downhole valve, the outer housing, and the inner mandrel, is exposed when the second seating surface unseats from the uphole facing sealing shoulder. First jarring surfaces are on the inner mandrel and outer housing respectively for jarring contact with each other during a jar in a first direction. Second jarring surfaces are on the inner mandrel and outer housing respectively for jarring contact with each other during a jar in a second direction. The uphole restriction and downhole restriction are separated such that when the uphole restriction slides relatively upward over the initial portion of the uphole valve to seat the uphole valve, at least a portion of the downhole restriction extends upwardly beyond a downhole end of the downhole valve sufficient to allow a jar in the first direction to be carried out, and when the downhole restriction slides relatively downward over the initial portion of the downhole valve to seat the downhole valve, at least a portion of the uphole restriction extends downwardly beyond an uphole end of the uphole valve sufficient to allow a jar in the second direction to be carried out.

A jar is also disclosed comprising an inner mandrel at least partially disposed telescopically within an outer housing to define a fluid chamber between the inner mandrel and the outer housing. The fluid chamber contains fluid and is sealed at an uphole end and at a downhole end. A restriction is within the fluid chamber between the uphole end and the downhole end. A valve is disposed within the fluid chamber, the valve having a seating surface at least at a first end of the valve, the seating surface engageable with a sealing shoulder in the fluid chamber to seat the valve when the restriction slides relatively in one of a downward or upward direction over at least an initial portion of the valve. The valve has an exterior surface that fits with close tolerance within the restriction over at least a portion of the exterior surface. A bypass, defined by at least one of the valve, the outer housing, and the inner mandrel, is exposed when the seating surface unseats from the sealing shoulder. Jarring surfaces on the inner mandrel and outer housing, respectively, for jarring contact with each other during a jar in the first direction. The restriction is spaced in the fluid chamber such that when the restriction slides relatively over the initial portion of the valve to seat the valve, a jar in the first direction may be carried out.

The jar disclosed herein is capable of being actuated to carry out repetitive upjars, and repetitive downjars, and is of a simple design.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIGS. 1, 2 and 3 illustrate the jar during operation at neutral, jarring, and re-setting positions, respectively.

FIGS. 4-8 illustrate the jar during operation at neutral, downjarring, re-setting from downjarring, upjarring, and re-setting from upjarring, positions, respectively.

DETAILED DESCRIPTION

Figure 1:
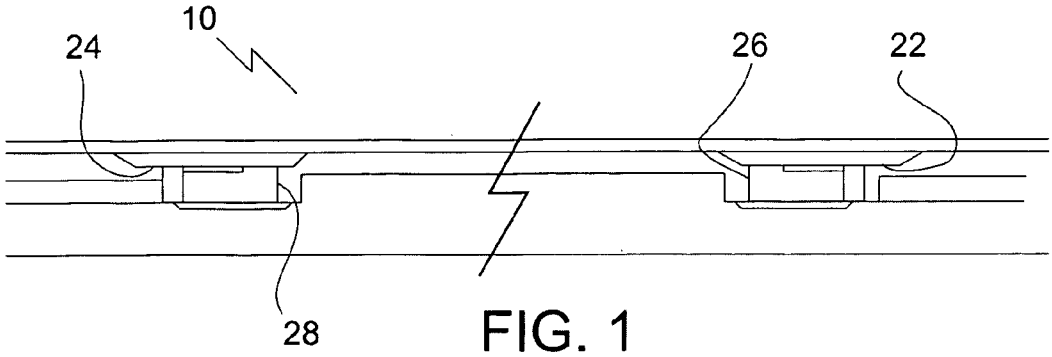
FIGS. 1-3 are partial side elevation views, in section and not to scale, illustrating the operation of one embodiment of a double-acting jar performing a jar in one direction.

Immaterial modifications may be made to the embodiments described here without departing from what is covered by the claims.

Drill jars provide a large transient force impact to a tubing string in either an upward or downward direction. A jar may have an inner mandrel disposed within an outer housing, defining a fluid chamber filled with hydraulic fluid in between the two. The hydraulic fluid may be gas or liquid. A tensile or compressive force is applied, through the tubing string, to either the outer housing or the inner mandrel of the jar, forcing the outer housing and inner mandrel to move relative to one another. The relative movement between the two is initially restricted within the fluid chamber, such that the energy of the tensile or compressive force builds up in the tubing string. As soon as the outer housing and inner mandrel move far enough relative to one another to clear the initial restriction, the energy built up in the tubing string is transferred into rapid relative motion between the inner mandrel and the outer housing. Jarring shoulders on both the inner mandrel and outer housing then impact one another, releasing a large amount of kinetic energy into the tubing string and causing a striking blow to the tubing string.

The double-acting jar disclosed herein may be used with coiled tubing. Adapting such a tool to a coiled tubing application presents some challenges to overcome. A coiled tubing operation may involve, for example, the use of a single continuous pipe or tubing. The tubing, which is coiled onto a reel and uncoiled as it is lowered into the well bore, can be used for, for example, drilling or workover applications. However, coiled tubing presents a number of working constraints to existing tool design. First of all, due to the limited size of the coiled tubing, limited compressive loads can be placed on the tubing by the rig operator. Essentially, this means that downhole tools which require compressive force to operate, such as a jarring tool, must be capable of operating with the limited compressive load capability of coiled tubing. In addition, in coiled tubing application the overall length of the downhole tool becomes significant since there is limited distance available between the stuffing box and the blowout preventor to accommodate the bottom hole assembly. A typical bottom hole assembly may include, for example, a quick disconnect, a sinker bar located below the quick disconnect to provide weight to the bottom hole assembly, the jar, a release tool below that of some type, and then an overshot. Other tools may also be present, as required. Thus, the length of the jarring tool itself becomes particularly significant since the entire bottom hole assembly may be required to fit within the limited distance between the stuffing box and blowout preventor to introduce it into a pressurized well. Furthermore, within these confines, the jarring tool may be required to have a large enough internal bore to permit pump-down tools to pass. Thus, the coiled-tubing jarring tool may have a limited overall wall thickness in view of limited outer diameter conditions.

As in the case with conventional drill pipe, coiled tubing or other down hole tools may get stuck in the well bore at times. Under these circumstances, repetitive upjarring or downjarring with a jarring tool may be useful. Many traditional double-acting jar tools do not perform this function, as upon resetting from a jar in one direction, only a jar in the opposite direction may be subsequently enacted. The double acting hydraulic jarring tool disclosed herein allows a user to re-set the double-acting jar tool after a jar in either direction, in order to allow a user to subsequently jar in either direction. In some embodiments this jarring tool design may be adapted for use in a conventional drill string as well.

Figures 13A, 13B, 13C:
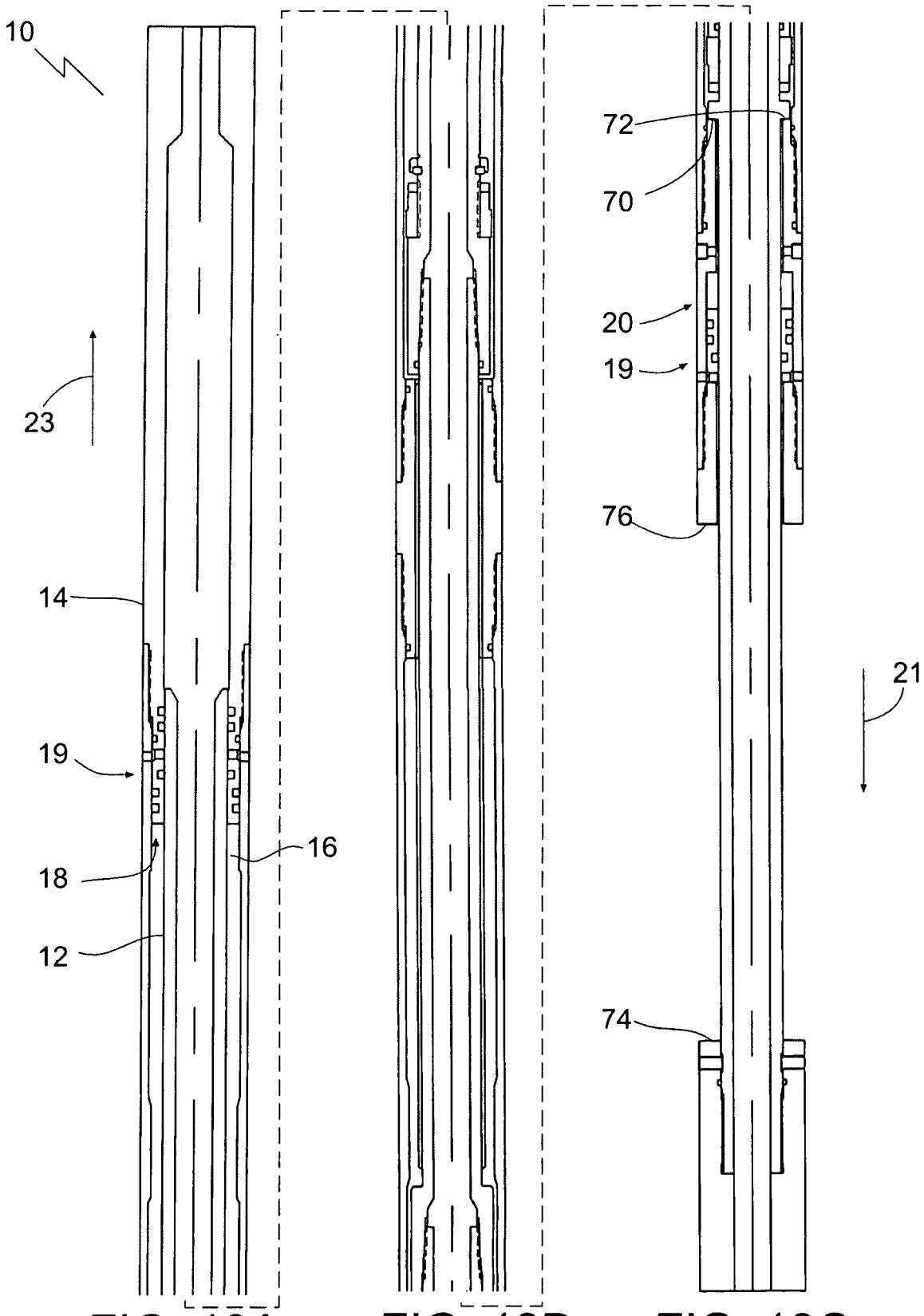
FIGS. 13A-13C form an exploded side elevation view, in section, of a double-acting jar jarred fully up.
Figures 14A, 14B, 14C:
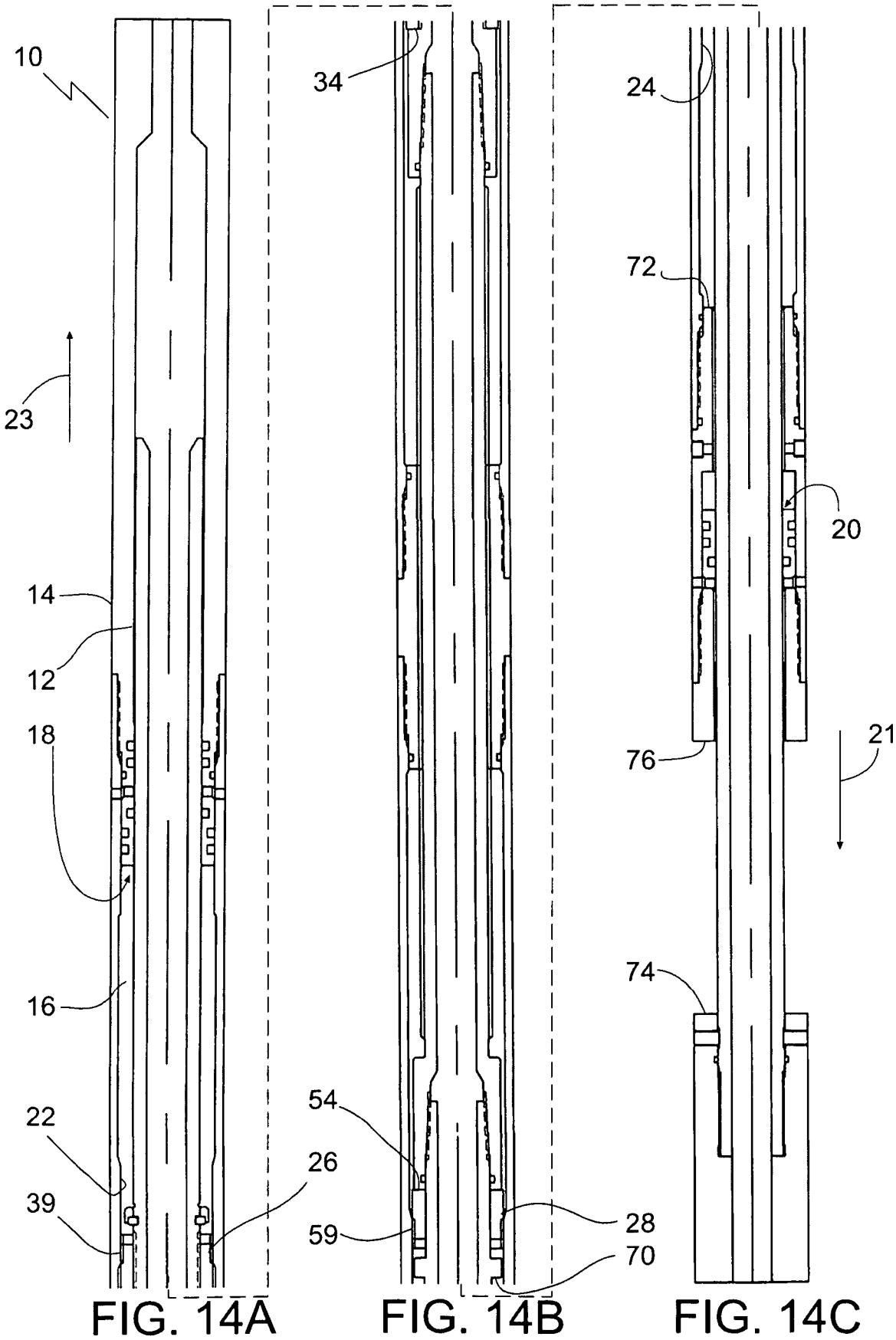
FIGS. 14A-14C form an exploded side elevation view, in section, of the double-acting jar of FIGS. 13A-13C in a neutral position.

Referring to FIGS. 14A-14C, a double-acting jar 10 illustrated, comprising an inner mandrel 12 and an outer housing 14. Inner mandrel 12 is at least partially disposed telescopically within outer housing 14 to define a fluid chamber 16 between inner mandrel 12 and outer housing 14. Fluid chamber 16 contains hydraulic fluid and is sealed at an uphole 18 end and a downhole end 20. Referring to FIGS. 13A and 13C, fluid chamber 16 may comprise a floating seal 19 at least one of uphole and downhole ends 18 and 20, respectively. Floating seal 19 allows pressure differentials between fluid chamber 16 and outside of jar 10 to equalize. This may prevent, for example, fluid chamber 16 from collapsing under extreme fluid pressures such as those experienced downhole. Fluid chamber 16 may be annular in shape. In some embodiments, there may be one or more fluid chambers 16 (plural fluid chambers), each one operating according to the embodiments disclosed herein for jarring operation. Either or both of inner mandrel 12 and outer housing 14 may be individually composed of, for example, one or more units connected together. Each unit may be, for example, threadably connected together as is well known in the art, and as is illustrated in the figures. Outer housing 14 and inner mandrel 12 may be, for example, tubulars. In the embodiment illustrated in FIGS. 14A-14C, in a downhole application, outer housing 14 would be connected, directly or indirectly, to a tubing string (not shown), whereas inner mandrel 12 would be connected, directly or indirectly, to, for example, a fishing tool (not shown). In some embodiments, this orientation is reversed. A skilled worker would understand that jar 10 could be oriented upside down in a well, and would still carry out the function of the jar.

Referring to FIGS. 14A-C, jar 10 has an uphole restriction 22 and a downhole restriction 24 spaced from one another within fluid chamber 16. Restrictions 22 and 24 are spaced from uphole end 18 and from downhole end 20 of fluid chamber 16. In the embodiment illustrated in FIGS. 14A-14C, restrictions 22 and 24 are located on outer housing 14. In some embodiments, either or both of restrictions 22 and 24 may be located on one or both of outer housing 14 and inner mandrel 12. Restrictions 22 and 24 may be, for example, shoulders. In the embodiment illustrated in FIGS. 14A-C, restrictions 22 and 24 are annular shoulders. Restrictions 22 and 24 may be of any length, and a worker skilled in the art would understand that variations in length will be required for different valve separation distances, as well as different desired jar forces.

Figure 4:
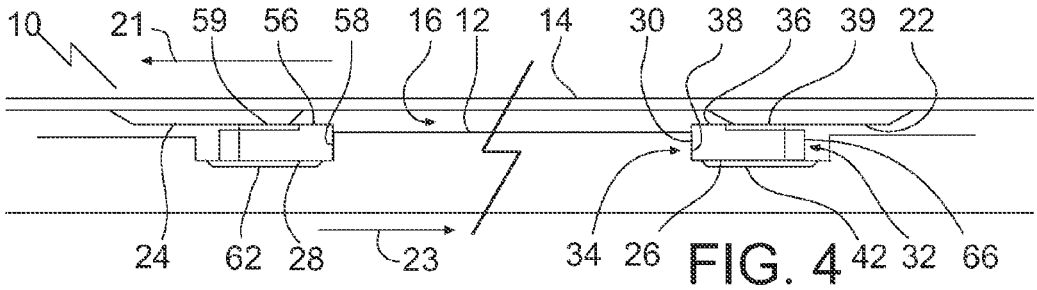
FIGS. 4-8 are partial side elevation views, in section and not to scale, illustrating the operation of another embodiment of a double-acting jar performing jars in both directions.
Figure 5:
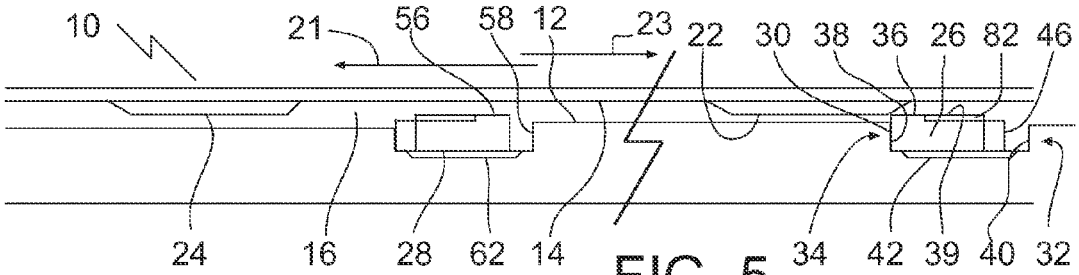
Figure 6:
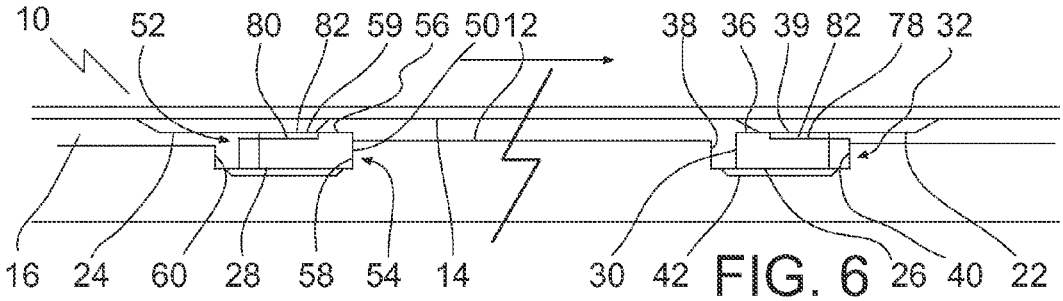
Figure 9:
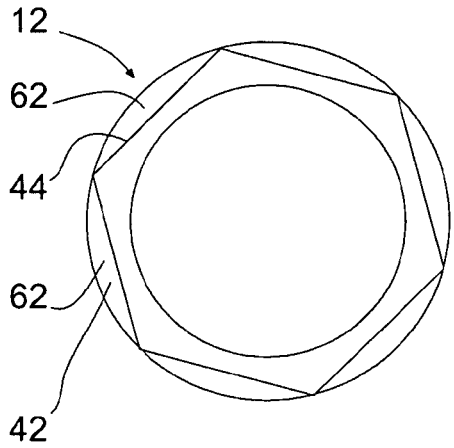
FIG. 9 is an end elevation view, in section, of an embodiment of a bypass positioned on the inner mandrel.
Figure 10:
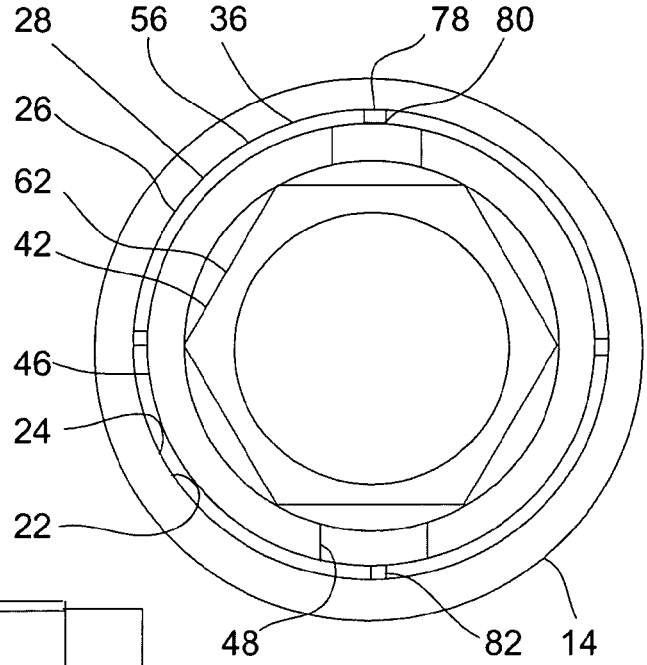
FIG. 10 is an end elevation view, in section, of an embodiment of a valve positioned over the bypass illustrated in FIG. 9, and fitted within the restriction of the outer housing.
Figure 12:
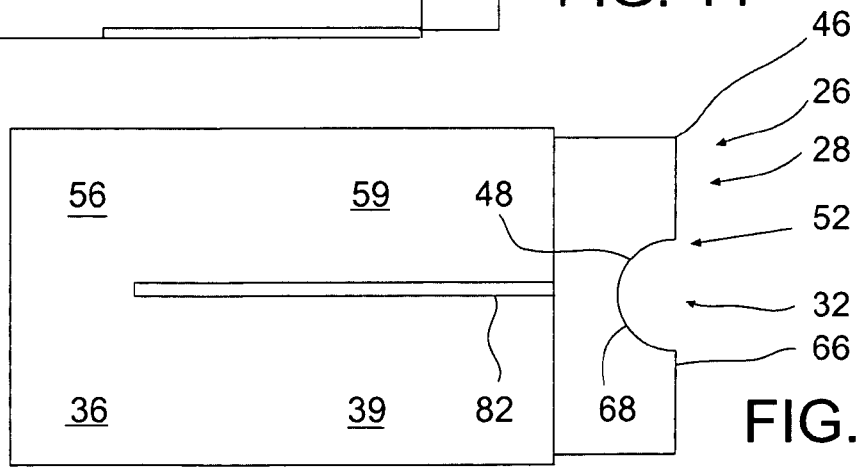
FIG. 12 is a top plan view of the valve of FIG. 11.
Figure 17:
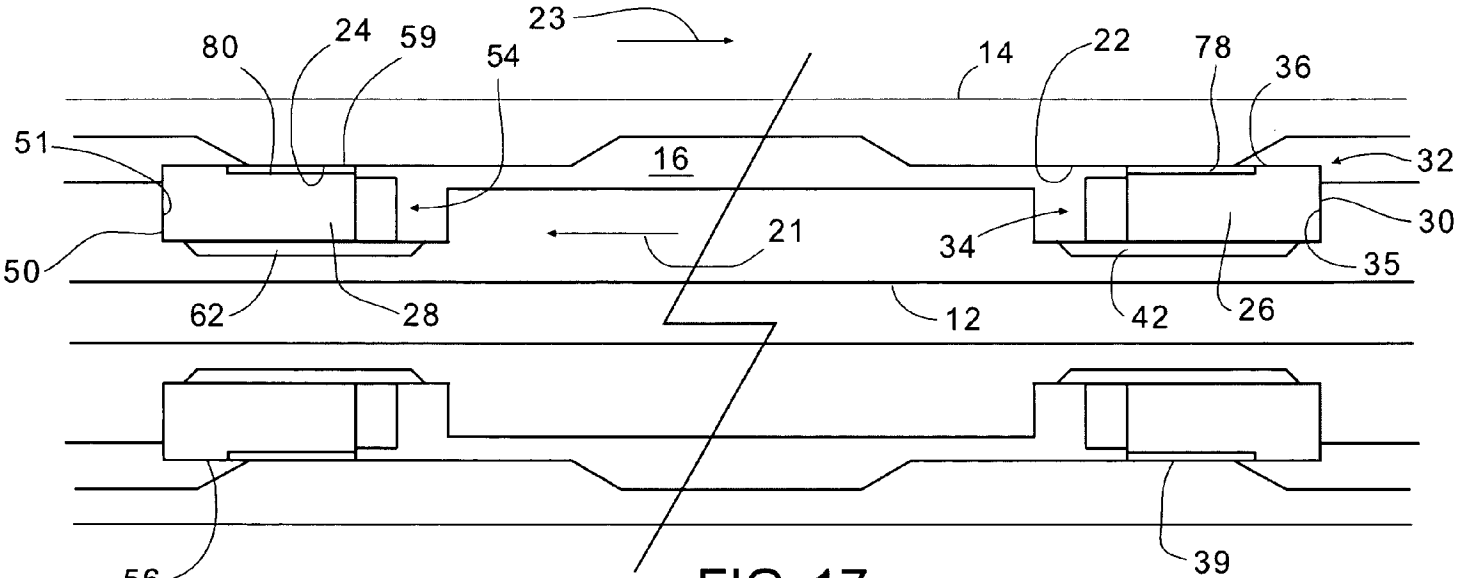
FIG. 17 is a partial side elevation view, in section and not to scale, of another embodiment of a double-acting jar.

An uphole valve 26 and an downhole valve 28 are disposed within fluid chamber 16. Referring to FIG. 4, uphole valve 26 and downhole valve 28 are illustrated in greater detail. Uphole valve 26 has a first seating surface 30, an uphole end 32, a downhole end 34, and a first exterior surface 36. Referring to FIGS. 5 and 6, first seating surface 30 is engageable with an uphole facing sealing shoulder 38 in fluid chamber 16. First seating surface 30 is engageable with uphole facing sealing shoulder 38 when uphole restriction 22 slides relatively downward over at least an initial portion 39 of uphole valve 26. Initial portion 39 may be the portion that must be traveled over to allow the valve 26 to slidably fit within restriction 22. Referring to FIG. 17, in some embodiments, first seating surface 30 may be engageable with a downhole facing sealing shoulder 35 to seat the uphole valve 26 when the upper restriction 22 slides relatively upward over at least initial portion 39 of the uphole valve 26. Referring to FIGS. 5 and 6, fluid chamber 16 may have a first retaining shoulder 40, and uphole valve 26 may be movable between uphole facing sealing shoulder 38 and first retaining shoulder 40. Referring to FIG. 6, a first bypass 42, defined by at least one of uphole valve 26, outer housing 14, and inner mandrel 12, is exposed when first seating surface 30 unseats from uphole facing sealing shoulder 38. Referring to FIG. 17, in the embodiment illustrated, first bypass 42 may be exposed when the first seating surface 30 unseats from the downhole facing sealing shoulder 35. In the embodiment illustrated in FIG. 6, first bypass 42 is defined on inner mandrel 12. First bypass 42 may extend underneath uphole valve 26 as illustrated, in order to allow fluid in fluid chamber 16 to communicate past uphole valve 26 when uphole valve 26 is unseated from uphole facing sealing shoulder 38. Referring to FIG. 9, which illustrates a cross-section of inner mandrel 12, one embodiment of first bypass 42 is illustrated. In this embodiment, first bypass 42 may comprise, for example, at least one beveled surface 44 on the surface of inner mandrel 12. In some embodiments, first bypass 42 may be defined on uphole facing sealing shoulder 38. Referring to FIG. 12, first bypass 42 may have a first fluid bypass in the uphole end 32 of the uphole valve 26, the first fluid bypass maintaining fluid flow from first bypass 42, across uphole end 32, and into fluid chamber 16. The first fluid bypass is illustrated in FIGS. 10 and 12 as, for example, a flange 46 having at least one cut-out portion 48. This way, even when uphole end 32 of uphole valve 26 is positioned up against first retaining shoulder 40, and first exterior surface 36 is in contact with uphole restriction 22, fluid may flow past uphole valve 26 through first bypass 42. Referring to FIGS. 10 and 12, first fluid bypass may have any type of means for allowing fluid communication through first bypass 42 and across uphole valve 26. In some embodiments, the first fluid bypass may be formed in uphole end 32, and in other embodiments, the first fluid bypass may extend from uphole end 32. Cut-out portion 48 may be, for example, a semi-circle as illustrated, or any other suitable shape. In some embodiments, first bypass 42 of uphole facing sealing shoulder 38 is at least partially defined by uphole valve 26. In further embodiments, first bypass 42 is defined entirely by uphole valve 26. In this embodiment, first bypass 42 may comprise, for example, a channel (not shown) from uphole end 32 to downhole end 34.

Referring to FIG. 10, at least a portion of first exterior surface 36 fits with close tolerance within uphole restriction 22 of outer housing 14, along at least a portion of first exterior surface 36. This way, when uphole restriction 22 slides downward over initial portion 39 of uphole valve 26 and causes uphole valve 26 to seat against uphole facing sealing shoulder 38, a fluid pressure differential will form across uphole valve 26. In some embodiments, at least a portion of initial portion 39 of the uphole valve 26 fits with close tolerance within the uphole restriction 22. In other embodiments, at least a portion of initial portion 59 of the downhole valve 28 fits with close tolerance within the downhole restriction 24. In cases where at least a portion of the initial portion fits within close tolerance within the restriction, it should be understood that the bypass channel is required to prevent the valve from pressuring up prior to the restriction passing over the initial portion. When uphole restriction 22 slides upward over uphole valve 26, this fluid pressure differential is prevented from forming, as uphole valve 26 unseats from uphole facing sealing shoulder 38, and fluid may flow through first bypass 42 to equalize the pressure.

Figure 8:
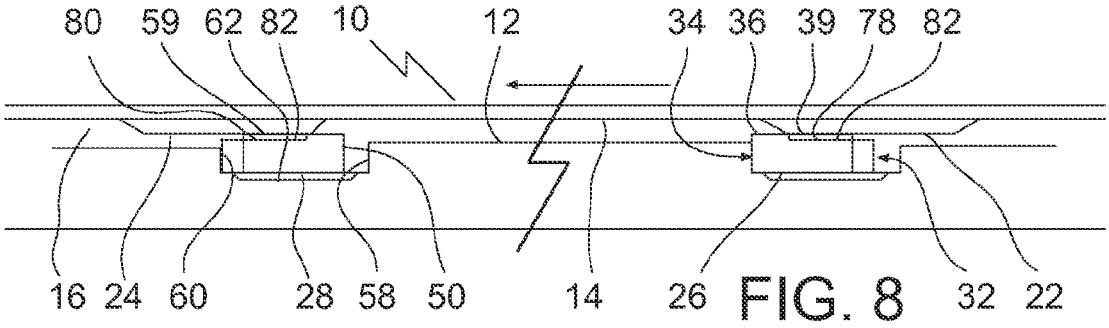
Figure 18:
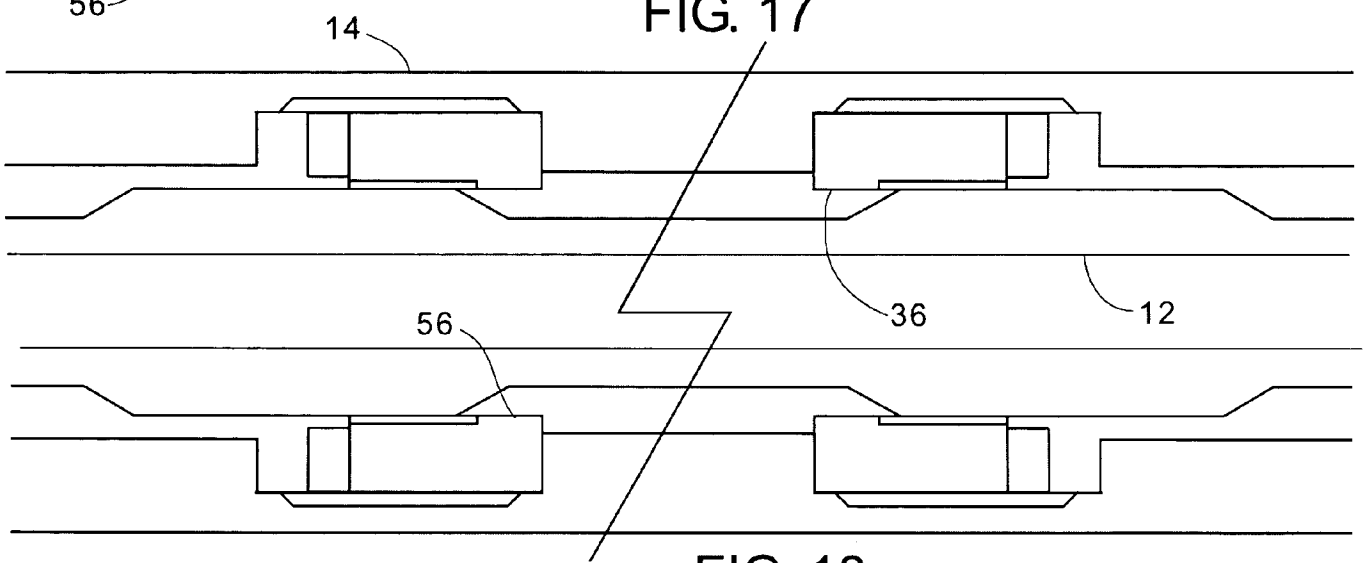
FIG. 18 is a partial side elevation view, in section and not to scale, of an embodiment of a double-acting jar with the restrictions located on the inner mandrel.

Referring to FIG. 6, downhole valve 28 has a second seating surface 50, a downhole end 52, an uphole end 54, and a second exterior surface 56. In some embodiments, for example the one illustrated in FIG. 4, at least one of the first exterior surface 36 and the second exterior surface 56 faces radially towards the outer housing. In other embodiments, such as the one illustrated in FIG. 18 for example, at least one of the first exterior surface 36 and the second exterior surface 56 may face radially towards the inner mandrel 12. In the embodiment shown in FIG. 18, restrictions 22 and 24 are defined on inner mandrel 12. Referring to FIGS. 6 and 8, second seating surface 50 is engageable with a downhole facing sealing shoulder 58 in fluid chamber 16. Second seating surface 50 is engageable with downhole facing sealing shoulder 58 at least when downhole restriction 24 slides relatively upward over at least an initial portion 59 of downhole valve 28. Referring to FIG. 17, in some embodiments second seating surface 50 may be engageable with an uphole facing sealing shoulder 51 in the fluid chamber 16 to seat the downhole valve 28 when the downhole restriction 24 slides relatively downward over at least initial portion 59 of the downhole valve 28. Referring to FIGS. 6 and 8, fluid chamber 16 may have a second retaining shoulder 60, and downhole valve 28 may be movable between downhole facing sealing shoulder 58 and second retaining shoulder 60. Referring to FIG. 8, a second bypass 62, defined by at least one of downhole valve 28, outer housing 14, and inner mandrel 12, is exposed when second seating surface 50 unseats from downhole facing sealing shoulder 58. In the embodiment illustrated in FIG. 17, second bypass 62 may be exposed when the second seating surface 50 unseats from the uphole facing sealing shoulder 51. In the embodiment illustrated in FIG. 8, second bypass 62 is defined on inner mandrel 12. Second bypass 62 may extend underneath downhole valve 28 as illustrated, in order to allow fluid in fluid chamber 16 to communicate past downhole valve 28 when downhole valve 28 is unseated from downhole facing sealing shoulder 58. Second bypass 62 may extend underneath downhole valve 28 as illustrated, in order to allow fluid in fluid chamber 16 to communicate past downhole valve 28 when downhole valve 28 is unseated from downhole facing sealing shoulder 58. Referring to FIG. 9, second bypass 62 is understood as having the same characteristics, and functioning in a similar manner as, first bypass 42. In some embodiments, second bypass 62 may be defined on downhole facing sealing shoulder 58. Referring to FIG. 12, second bypass 62 may have a second fluid bypass in the downhole end 52 of the downhole valve 28, the second fluid bypass maintaining fluid flow from second bypass 62, across downhole end 52, and into fluid chamber 16. The second fluid bypass is illustrated in FIG. 6 as, for example, a flange 66 having at least one cut-out portion 68 (illustrated in FIG. 12). The second fluid bypass is understood as including the same characteristics, and functioning in a similar manner as the first fluid bypass. This way, even when downhole end 52 of uphole valve 28 is positioned up against second retaining shoulder 60, and second exterior surface 56 is in contact with downhole restriction 24, fluid may flow past downhole valve 28 through second bypass 62. In some embodiments, second bypass 62 of downhole facing sealing shoulder 58 is at least partially defined by downhole valve 28. In further embodiments, second bypass 62 is defined entirely by downhole valve 28. In this embodiment, second bypass 62 may comprise, for example, a channel (not shown) from downhole end 52 to uphole end 54.

Referring to FIG. 10, second exterior surface 56 fits with close tolerance within downhole restriction 24 of outer housing 14 over at least a portion of second exterior surface 56. This way, when downhole restriction 24 slides upward over initial portion 59 of downhole valve 28 and causes downhole valve 28 to seat against downhole facing sealing shoulder 58, a fluid pressure differential will form across downhole valve 28. When downhole restriction 24 slides downward over downhole valve 28, this fluid pressure differential is prevented from forming, as downhole valve 28 unseats from downhole facing sealing shoulder 58, and fluid may flow through second bypass 62 to equalize the pressure.

Figures 15A, 15B, 15C:
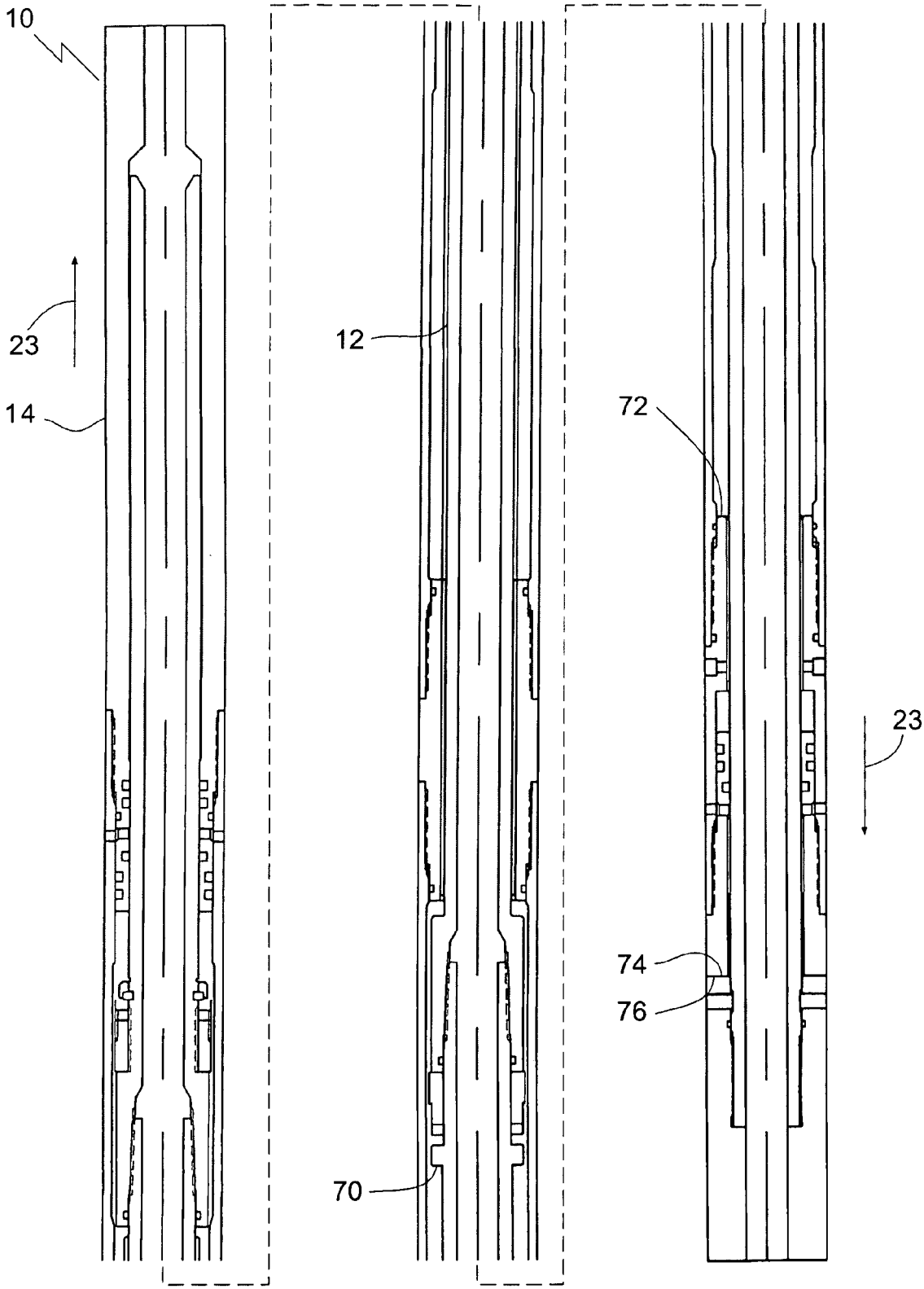
FIGS. 15A-15C form an exploded side elevation view, in section, of the double-acting jar of FIGS. 13A-13C jarred fully down.

Referring to FIGS. 13C and 14B-C, jar 10 has first jarring surfaces 70 and 72 on inner mandrel 12 and outer housing 14, respectively, for jarring contact with each other during a jar in a first direction 21, such as an downjar for example. A downjar stroke is illustrated from FIGS. 14A-C to 15A-C. Referring to FIGS. 14C and 15C, jar 10 has second jarring surfaces 74 and 76 on inner mandrel 12 and outer housing 14, respectively, for jarring contact with each other during a jar in a second direction 23, such as an upjar for example. An upjar stroke is illustrated from FIGS. 14A-C to 13A-C. A downjar stroke is illustrated from FIGS. 14A-C to 15A-C. A worker skilled in the art would understand that first jarring surfaces 70 and 72, and second jarring surfaces 74 and 76 may be formed at any suitable location on jar 10, such that they are able to collide with one another to release the force of the jarring motion in a striking impact. It should be understood that depending on which one of inner mandrel 12 and outer housing 14 is attached, directly or indirectly, to, for example, a stuck object, and which of the other one of inner mandrel 12 and outer housing 14 is attached, directly or indirectly, to the tubing string, relative movement of the restrictions 22 and 24 over the valves 26 and 28 will cause a jar in either direction 21 or 23 to be carried out. Referring to FIG. 5, for example, if inner mandrel 12 is attached to a stuck tool (not shown) downhole, and outer housing 14 is attached to a tubing string (not shown), then relative downward movement of uphole restriction 22 over uphole valve 26 (by pushing outer housing 14 in the first direction 21) will cause a downjar to be carried out. Similarly, if inner mandrel 12 is attached to the tubing string and outer housing 14 is attached to the stuck tool, then relative downward movement of uphole restriction 22 over uphole valve 26 (by pulling inner mandrel 12 in the second direction 23) will cause an upjar to be carried out.

Figure 2:
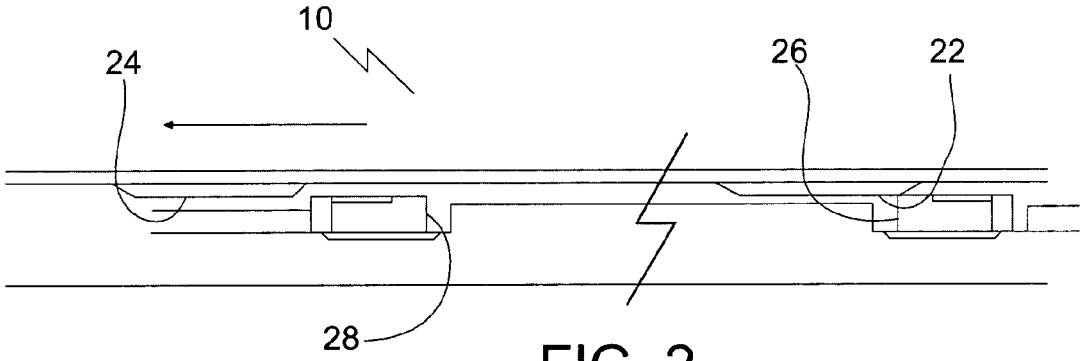
Figure 3:
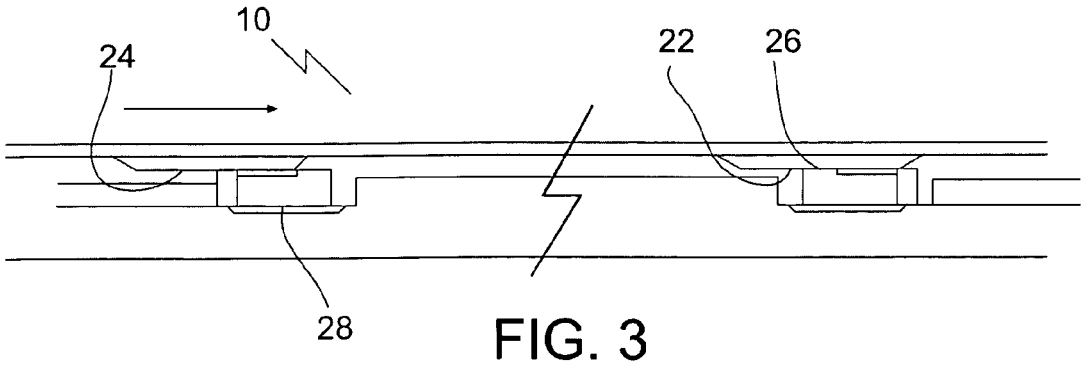

Referring to FIGS. 14A-14C, in the embodiment illustrated, uphole restriction 22 and downhole restriction 24 are separated such that when downhole restriction 24 slides relatively upward over initial portion 59 of downhole valve 28 to seat downhole valve 28, at least a portion of uphole restriction 22 extends upwardly beyond downhole end 34 of uphole valve 26 sufficient to allow a jar in the first direction 21 to be carried out. Uphole restriction 22 and downhole restriction 24 are also separated such that when uphole restriction 22 slides downward over initial portion 39 of uphole valve 26 to seat uphole valve 26, at least a portion of downhole restriction 24 extends downwardly beyond uphole end 54 of downhole valve 28 sufficient to allow a jar in the second direction 23 to be carried out. Downhole valve 28 and uphole valve 26 are separated to permit a respective downjar or upjar to be deliverable when downhole restriction 24 or uphole restriction 22, respectively, slide upward or downward, respectively, over initial portion 59 or 39, respectively in order to seat downhole valve 28 or uphole valve 26, respectively. Referring to FIGS. 6 and 8, during re-setting of jar 10 after an initial jar in one direction, at some point the respective one of downhole valve 28 or uphole valve 26 seats and pressures up. At that point, the separation of downhole and uphole valves 28 and 26 must be close enough to ensure that, by reversing the direction of the outer housing 14, a subsequent jar may be carried out in the same direction as the initial jar was carried out. In other words, at soon as one valve seats in one direction, the other valve must have enough travel along its respective restriction in the opposite direction to enact another jar in the opposite direction. The separation distance between, and the lengths of, valves 26 and 28 is relative to the separation distance between, and the corresponding lengths of, restrictions 22 and 24. In general, however, jar 10 may be required to be as short as possible, and this may play a role in determining the separation distances and lengths of each of restrictions 22, 24 and valves 26, 28. Referring to FIGS. 1-3, an embodiment of jar 10 is illustrated with valves 26 and 28 separated a greater distance apart relative to the separation of restrictions 22 and 24, in contrast to the embodiment of FIGS. 4-8. Jar 10 is actuatable to deliver an upjar or downjar repeatedly.

Referring to FIG. 17, in the embodiment illustrated, the orientation of the valves is reversed from the embodiment described for FIGS. 14A-C above. In this embodiment, uphole restriction 22 and downhole restriction 24 are separated such that when the uphole restriction 22 slides relatively upward over the initial portion 39 of the uphole valve 26 to seat the uphole valve 26, at least a portion of the downhole restriction 24 extends upwardly beyond downhole end 52 of the downhole valve 26 sufficient to allow a jar in the first direction 21 to be carried out. Also, restrictions 22 and 24 are separated such that when the downhole restriction 24 slides relatively downward over the initial portion 59 of the downhole valve 28 to seat the downhole valve 28, at least a portion of the uphole restriction 22 extends downwardly beyond uphole end 32 of the uphole valve 26 sufficient to allow a jar in the second direction 23 to be carried out.

Figure 11:
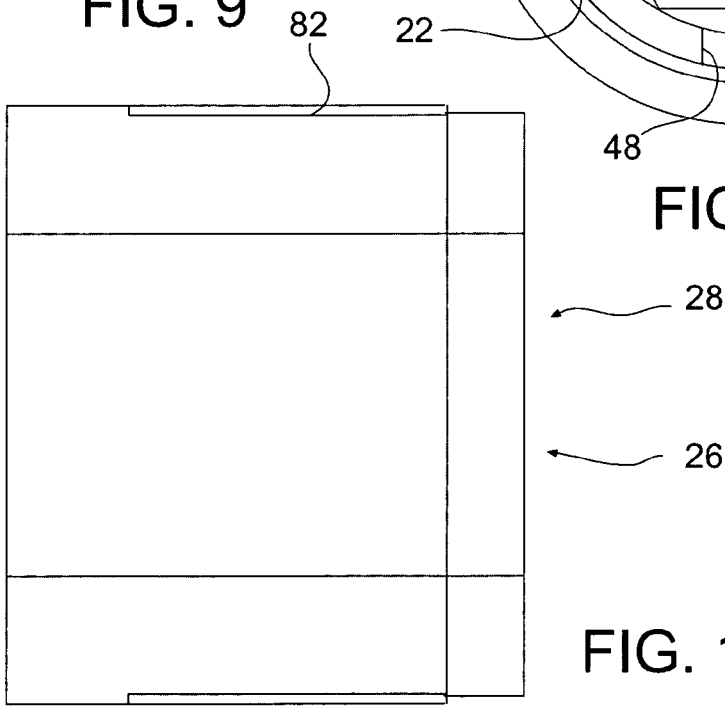
FIG. 11 is a side elevation view, in section, of an embodiment of a valve used in a double-acting jar.
Figure 16C:
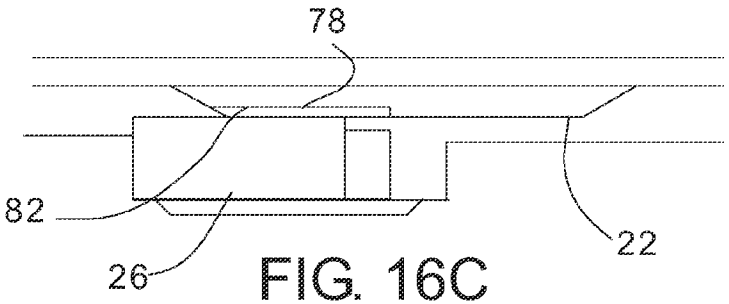
FIGS. 16A-E are partial side elevation views, in section and not to scale, of different embodiments of bypass channels.
Figure 16D:
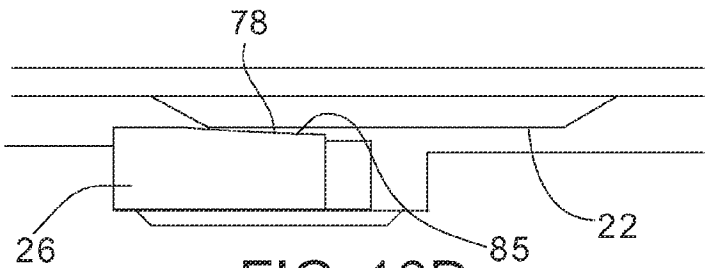
Figure 16E:
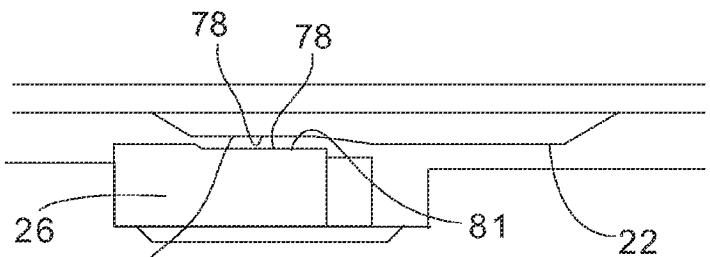
Figure 16A:
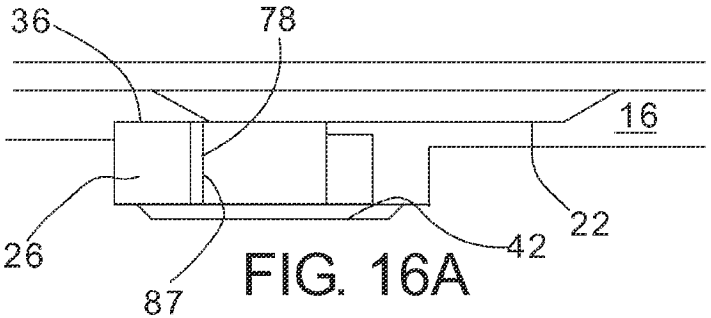
Figure 16B:
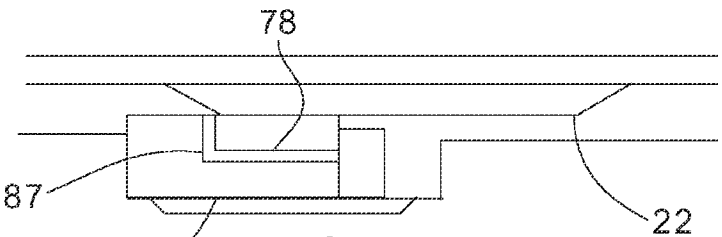

Referring to FIG. 8, jar 10 may further comprise at least a first bypass channel 78 extending into uphole valve 26 from uphole end 32 of uphole valve 26. First bypass channel 78 may be defined by at least one of uphole valve 26 and the uphole restriction 22 to allow bypass of fluid from uphole end 32 of the uphole valve 26 to the first exterior surface 36 as uphole restriction 22 slides relatively downward over initial portion 39 of uphole valve 26. It should be understood that at least a portion of first exterior surface 36 must fit with close tolerance with restriction 22 between first bypass channel 78 and downhole end 34 in order to allow valve 26 to pressure up after seating. Referring to FIG. 6, jar 10 may further comprise at least a second bypass channel 80 extending into downhole valve 28 from downhole end 52 of downhole valve 28. Second bypass channel 80 may be defined by at least one of the downhole valve 28 and the downhole restriction 24 to allow bypass of fluid from downhole end 52 of the downhole valve 28 to the second exterior surface 56 as the downhole restriction 24 slides relatively upward over the initial portion 59 of the downhole valve 28. It should be understood that at least a portion of second exterior surface 56 must fit with close tolerance with restriction 24 between second bypass channel 80 and uphole end 54, in order to allow valve 28 to pressure up after seating. The second bypass channel 80 may extend to second exterior surface 56 to allow bypass of fluid as downhole restriction 24 slides relatively upward over initial portion 59 of downhole valve 28. Referring to FIG. 6 first bypass channel 78 may comprise a slot 82 along at least one of the initial portion 39 and the uphole restriction 22. Referring to FIG. 16C, an embodiment is illustrated in which slot 82 is defined by uphole restriction 22. Similarly, referring to FIG. 6, second bypass channel 80 may comprise a slot 82 along a portion of at least one of the initial portion 59 and the downhole restriction 24. Referring to FIGS. 16D-E, first bypass channel 78 may comprise at least one of a reduced thickness section (represented by reference numeral 81 on initial portion 39 in FIG. 16E) and a tapered section (represented by reference numeral 85 on initial portion 39 in FIG. 16D) along a portion of at least one of the initial portion 39 of the uphole valve 26 and the uphole restriction 22. The reduced thickness section may be, for example, a reduced or increased diameter section. Similarly, the second bypass channel 80 (not shown) may also comprise at least one of a reduced thickness section and a tapered section along a portion of at least one of the initial portion 59 of the downhole valve 28 and the downhole restriction 24. Referring to FIGS. 16A-B, the first bypass channel 78 may comprise an inner channel 87. Referring to FIG. 16B, inner channel 87 is cut through the interior of uphole valve 26. Referring to FIG. 16A, in some embodiments, inner channel 87 is defined in the uphole valve 26 between first exterior surface 36 and the first bypass 42. In this way, inner channel 87 communicates with first bypass 42 and first bypass channel 78 includes a portion of first bypass 42. Similarly, second bypass channel 80 may comprise an inner channel (not shown), and the inner channel may be defined in the downhole valve 28 between the second exterior surface 56 and the second bypass 62. In some embodiments, first bypass channel 78 may be defined on both initial portion 39 and restriction 22. Referring to FIG. 16E, an example of this is illustrated where first bypass channel 78 is defined on both of initial portion 39 and uphole restriction 22, with reduced thickness section 83 being defined on uphole restriction 22. In some embodiments, second bypass channel 80 may be defined on both initial portion 59 and restriction 24. Further, in some embodiments, combinations of the different types of bypass channels are possible for the bypass channels. In addition, in some embodiments, plural bypass channels are possible. For example, referring to FIG. 10, four slots 82 are defined on valve 26. In some embodiments, second bypass channel 80 is understood as having the same characteristics, and functioning in a similar manner as, first bypass channel 78. Referring to FIGS. 10-12, slot 82 may be a surface slot, and may be positioned axially along the initial portions 39 and 59 of valves 26 and 28, respectively. Referring to FIGS. 8 and 6, first and second bypass channels 78 and 80, respectively, allow the respective one of valves 26 or 28 to fit properly within restrictions 22 or 24, prior to building up the fluid pressure differential when either of valves 26 or 28 seat and pressure up. Because of the close-tolerance fitting of exterior surfaces 36 and 56 within restrictions 22 and 24, respectively, first and second bypass channels 78 and 80 allow valves 26 and 28, respectively, to align properly, and reduce the occurrence of valves 26 and 28 jamming upon attempted entry into restrictions 22 and 24, respectively. Because it has been known that the valve may actually expand upon entry into the restriction when the pressure differential is created, it is advantageous that the valve be sufficiently positioned within the restriction when this pressure differential builds up, so that the jar will work effectively. First and second bypass channels 78 and 80 may be added to valves 26 and 28, by retrofitting. The addition of slot 82 may provide a partial restriction near the seating point that may be equalized if motion of outer housing 14 is ceased relative to inner mandrel 12.

Referring to FIG. 17, in the embodiment illustrated, first bypass channel 78 allows bypass of fluid from downhole end 34 of the uphole valve 26 to the first exterior surface 36 as the uphole restriction 22 slides relatively upward over the initial portion 39 of the uphole valve 26. Similarly, second bypass channel 80 allows bypass of fluid from uphole end 54 of the downhole valve 28 to the second exterior surface 56 as the downhole restriction 22 slides relatively downward over the initial portion 59 of the downhole valve 28.

Referring to FIGS. 8 and 6, initial portions 39 and 59 are defined as the portions of first and second exterior surfaces 36 and 56, respectively, that the respective restriction 22 and 24 must pass over in a respective downward or upward direction in order to seat the respective valve 26 or 28. If first or second bypass channels 78 or 80 are not present, initial portions 39 and 59 may be defined closer to uphole or downhole ends 32 or 52, respectively, although this is not required.

Referring to FIGS. 14A-14C, and FIG. 4, jar 10 is illustrated in a neutral position. From this position, an upjar or a downjar may be selectively carried out. Referring to FIGS. 5 and 6, operation of jar 10 during a downjar is illustrated. Referring to FIGS. 4 and 5, outer housing 14 is first slide in a downward direction relative to inner mandrel 12. During this motion, although downhole restriction 24 may be slid over second exterior surface 56, fluid may still communicate across downhole valve 28 through second bypass 62, as downhole valve 28 is biased into being unseated from downhole facing sealing shoulder 58. Therefore, no fluid pressure differential builds up across downhole valve 28. As soon as uphole restriction 22 slides over initial portion 39 of uphole valve 26, uphole valve 26 is biased into the seated position, and a fluid pressure differential builds across uphole valve 26. The fluid pressure differential builds up as uphole restriction 22 travels across first exterior surface 36, compressing and expanding the fluid contained in fluid chamber 16 downward and upward, respectively, of uphole valve 26. This acts to greatly restrict the downward relative motion of outer housing 14 over inner mandrel 12. Referring to FIG. 5, as soon as uphole restriction 22 clears first exterior surface 36, the energy stored in fluid chamber 16 upwards and downwards of uphole valve 26 is suddenly released, and transferred into rapid relative motion of outer housing 14 over inner mandrel 12. Referring to FIG. 15C, the kinetic energy of outer housing 14 relative to inner mandrel 12 is then released upon colliding impact between second jarring surfaces 74 and 76. This impact delivers a downward jarring impact to the tubing string. Referring to FIG. 6, the jar 10 is then re-set back to neutral. This is accomplished by moving outer housing 14 in an upward direction relative to inner mandrel 12. During this motion, the motion of outer housing 14 is relatively unrestricted, until downhole restriction 24 slides over initial portion 59 of downhole valve 28. At this point, the upward motion of outer housing 14 is retarded, as downhole valve 28 is pushed into the seated position, and a fluid pressure differential begins to build up across downhole valve 28. At this stage, a user of jar 10 may then carry out either another downjar, or an upjar, as the jar 10 is effectively in a neutral position.

Figure 7:
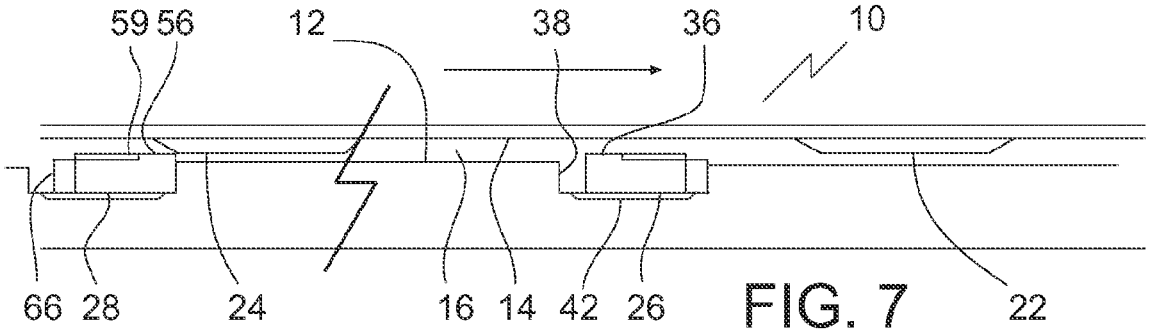

Referring to FIGS. 7 and 8, operation of jar 10 during an upjar is illustrated. Referring to FIGS. 4 and 7, outer housing 14 is slide in an upward direction relative to inner mandrel 12. During this motion, although uphole restriction 22 may be slid over first exterior surface 36, fluid may still communicate across uphole valve 26 through first bypass 42, as uphole valve 26 is biased into being unseated from uphole facing sealing shoulder 38. Therefore, the fluid pressure differential is prevented from building up across uphole valve 26. As soon as downhole restriction 24 slides over initial portion 59 of downhole valve 28, downhole valve 28 is biased into the seated position, and a fluid pressure differential builds across downhole valve 28. The pressure differential builds up as downhole restriction 24 travels across second exterior surface 56, compressing and expanding the fluid contained in fluid chamber 16 upward and downward, respectively, of downhole valve 28. This acts to greatly restrict the upward relative motion of outer housing 14 over inner mandrel 12. Referring to FIG. 7, as soon as downhole restriction 24 clears second exterior surface 56, the energy stored in fluid chamber 16 above and below downhole valve 28 is suddenly released, and transferred into rapid relative motion of outer housing 14 over inner mandrel 12. Referring to FIG. 13C, the kinetic energy of outer housing 14 relative to inner mandrel 12 is then released upon colliding impact between first jarring surfaces 70 and 72. This impact delivers an upward jarring impact to the tubing string. Referring to FIG. 8, jar 10 is then re-set back to neutral. This is accomplished by moving outer housing 14 in a downward direction relative to inner mandrel 12. During this motion, the motion of outer housing 14 is relatively unrestricted, until uphole restriction 22 slides over initial portion 39 of uphole valve 26. At this point, the downward motion of outer housing 14 is retarded, as uphole valve 26 is pushed into the seated position, and a fluid pressure differential begins to build up across uphole valve 26. At this stage, a user of jar 10 may then carry out either another downjar, or an upjar, as the jar 10 is effectively in a neutral position.

In some embodiments, double-acting jar 10 may be used with a jar enhancing device (not shown), in order to compound the jarring force of jar 10. A jar enhancing device may be connected, for example, either directly or indirectly above jar 10 in the tubing string. By applying a compressive or tensile force to the tubing string, the jar enhancer uses, for example, a fluid or mechanical spring to allow additional force to be built up prior to the release of that force in either an up or a down jar. Jar enhancers are useful additions with, for example, a coiled tubing jarring operation, because they allow additional force to be built up for a jar, without imposing additional strain on the already limited compressive and tensile stress of the tubing string itself.

Jars 10 of the type disclosed herein may be used in, for example, fishing operations, drilling operations, coiled tubing, and drill strings. The use of up or down in this document illustrates relative motions within jar 10, and are not intended to be limited to vertical motions, or upward and downward motions. It should be understood that jar 10 may be used in any type of well, including, for example, vertical, deviated, and horizontal wells. First and second exterior surfaces 36 and 56 may include at least one of the outer and inner surfaces of valves 26 and 28, respectively.

In some embodiments, the principles and characteristics of the double-acting jar 10 may be applied to work as a single-acting jar. Referring to FIG. 4, a single-acting jar may be envisioned by reference only to, for example, the right hand side of the image before the cut-off lines. In this embodiment, restriction 22 is positioned within the fluid chamber 16 between the uphole end 18 and the downhole end 20 (not shown). Valve 26 is disposed within the fluid chamber 16, the valve 26 having seating surface 30 at least at a first end (illustrated for example by downhole end 34 of the valve 26, the seating surface 30 being engageable with sealing shoulder 38 in the fluid chamber 16 to seat the valve 26 when the restriction 22 slides relatively in one of a downward or upward direction over at least initial portion 39 of the valve 26. In the embodiment illustrated, the valve 26 is configured to seat when the restriction 22 slides relatively downward over initial portion 39. Again, like the double-acting jar 10, depending on which one of inner mandrel 12 and outer housing 14 is connected directly or indirectly to the tubing string, relative downward or upward movement of restriction 22 over initial portion 39 to seat valve 26 will cause a jar to be carried out in either direction 21, 23. Exterior surface 36 fits with close tolerance within restriction 22 over at least a portion of exterior surface 36. In this embodiment, valve 26 need not be referred to as uphole or downhole, and restriction 22 need not be referred to as uphole or downhole. Similarly, sealing shoulder 38 may be either uphole facing or downhole facing, depending on the direction of jarring that is desired. In the embodiment illustrated by the right hand side of FIG. 4, the valve is oriented to jar in the first direction 21, for example. Similar to the double-acting jar 10, bypass 42 is exposed when seating surface 30 unseats from sealing shoulder 38. In this embodiment, only one set of jarring surfaces (not shown) are required on the inner mandrel 12 and outer housing 14, respectively, for jarring contact with each other during a jar in the first direction 21. Restriction 22 is spaced in the fluid chamber 16 such that when the restriction 22 slides relatively over the initial portion 39 of the valve 26 to seat the valve 26, a jar in the first direction 21 may be carried out. The single-acting jar, similar to the double-acting jar 10 may further comprise bypass channel 78 that allows bypass of fluid from a second end (illustrated as uphole end 32) of the valve 26 opposite the first end (illustrated as downhole end 34) to the exterior surface 36 as the restriction 22 slides relatively over the initial portion 39 of the valve 26. It should be understood that the single-acting jar, while only having the capacity to jar in one direction, may still have all of the relevant characteristics as the various embodiments of the double-acting jar 10 have.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The invention claimed is:

1. A double-acting jar comprising:

an inner mandrel and an outer housing;

the inner mandrel being at least partially disposed telescopically within the outer housing to define a fluid chamber between the inner mandrel and the outer housing, the fluid chamber containing fluid and being sealed at an uphole end and at a downhole end;

an uphole restriction and a downhole restriction spaced from one another within the fluid chamber and spaced from the uphole end and from the downhole end;

an uphole valve disposed within the fluid chamber, the uphole valve having a first seating surface engageable with an uphole facing sealing shoulder in the fluid chamber to seat the uphole valve when the upper restriction slides relatively downward over at least an initial portion of the uphole valve, the uphole valve having a first exterior surface that fits with close tolerance within the uphole restriction over at least a portion of the first exterior surface;

a first bypass, defined by at least one of the uphole valve, the outer housing, and the inner mandrel, is exposed when the first seating surface unseats from the uphole facing sealing shoulder;

a downhole valve disposed within the fluid chamber, the downhole valve having a second seating surface engageable with a downhole facing sealing shoulder in the fluid chamber to seat the downhole valve when the downhole restriction slides relatively upward over at least an initial portion of the downhole valve, the downhole valve having a second exterior surface that fits with close tolerance within the downhole restriction over at least a portion of the second exterior surface;

a second bypass, defined by at least one of the downhole valve, the outer housing, and the inner mandrel, is exposed when the second seating surface unseats from the downhole facing sealing shoulder;

first jarring surfaces on the inner mandrel and outer housing respectively for jarring contact with each other during a jar in a first direction; and second jarring surfaces on the inner mandrel and outer housing respectively for jarring contact with each other during a jar in a second direction;

the uphole restriction and downhole restriction being separated such that when the downhole restriction slides relatively upward over the initial portion of the downhole valve to seat the downhole valve, at least a portion of the uphole restriction extends upwardly beyond a downhole end of the uphole valve sufficient to allow a jar in the first direction to be carried out, and when the uphole restriction slides relatively downward over the initial portion of the uphole valve to seat the uphole valve, at least a portion of the downhole restriction extends downwardly beyond an uphole end of the downhole valve sufficient to allow a jar in the second direction to be carried out.

2. The double-acting jar of claim 1 further comprising a first bypass channel defined by at least one of the uphole valve and the uphole restriction to allow bypass of fluid from an uphole end of the uphole valve to the first exterior surface as the uphole restriction slides relatively downward over the initial portion of the uphole valve.

3. The double-acting jar of claim 2 in which the first bypass channel comprises a slot along at least one of the initial portion of the uphole valve and the uphole restriction.

4. The double-acting jar of claim 2 in which the first bypass channel comprises at least one of a reduced thickness section and a tapered section along a portion of at least one of the initial portion of the uphole valve and the uphole restriction.

5. The double-acting jar of claim 2 in which the first bypass channel comprises an inner channel.

6. The double-acting jar of claim 5 in which the inner channel is defined in the uphole valve between the first exterior surface and the first bypass.

7. The double-acting jar of claim 2 in which at least a portion of the initial portion of the uphole valve fits with close tolerance within the uphole restriction.

8. The double-acting jar of claim 2 in which at least a portion of the initial portion of the downhole valve fits with close tolerance within the downhole restriction.

9. The double-acting jar of claim 1 further comprising a second bypass channel defined by at least one of the downhole valve and the downhole restriction to allow bypass of fluid from a downhole end of the downhole valve to the second exterior surface as the downhole restriction slides relatively upward over the initial portion of the downhole valve.

10. The double-acting jar of claim 9 in which the second bypass channel comprises a slot along a portion of at least one of the initial portion of the downhole valve and the downhole restriction.

11. The double-acting jar of claim 9 in which the second bypass channel comprises at least one of a reduced thickness section and a tapered section along a portion of at least one of the initial portion of the downhole valve and the downhole restriction.

12. The double-acting jar of claim 9 in which the second bypass channel comprises an inner channel.

13. The double-acting jar of claim 12 in which the inner channel is defined in the downhole valve between the second exterior surface and the second bypass.

14. The double-acting jar of claim 1 in which at least one of the first exterior surface and the second exterior surface faces radially towards the outer housing.

15. The double-acting jar of claim 1 in which the fluid chamber is annular in shape.

16. The double-acting jar of claim 1 in which at least one of the uphole restriction and the downhole restriction is defined on at least one of the outer housing and the inner mandrel.

17. The double-acting jar of claim 1 in which at least one of the uphole restriction and the downhole restriction comprises a shoulder.

18. The double-acting jar of claim 17 in which the shoulder comprises an annular shoulder.

19. The double-acting jar of claim 1 further comprising plural fluid chambers.

20. The double acting jar of claim 1 in which the fluid chamber further comprises a first retaining shoulder, the uphole valve being movable between the first retaining shoulder and the uphole facing sealing shoulder.

21. The double-acting jar of claim 20 in which the first bypass further comprises a first fluid bypass in the uphole end of the uphole valve, the first fluid bypass maintaining fluid flow from the first bypass, across the uphole end, and into the fluid chamber.

22. The double-acting jar of claim 21 in which the first fluid bypass comprises a flange having at least one cut-out portion.

23. The double acting jar of claim 1 in which the fluid chamber further comprises a second retaining shoulder, the downhole valve being movable between the second retaining shoulder and the second seating surface.

24. The double-acting jar of claim 23 in which the second bypass further comprises a second fluid bypass in the downhole end of the downhole valve, the second fluid bypass maintaining fluid flow from the second bypass, across the downhole end, and into the fluid chamber.

25. The double-acting jar of claim 24 in which the second fluid bypass comprises a flange having at least one cut-out portion.

26. The double-acting jar of claim 1 further comprising a floating seal at at least one of the uphole end and the downhole end.

27. The double-acting jar of claim 1 used in a fishing operation.

28. The double-acting jar of claim 1 used in a coiled tubing or drill string operation.

29. A double-acting jar comprising:

an inner mandrel and an outer housing;

the inner mandrel being at least partially disposed telescopically within the outer housing to define a fluid chamber between the inner mandrel and the outer housing, the fluid chamber containing fluid and being sealed at an uphole end and at a downhole end;

an uphole restriction and a downhole restriction spaced from one another within the fluid chamber and spaced from the uphole end and from the downhole end;

an uphole valve disposed within the fluid chamber, the uphole valve having a first seating surface engageable with a downhole facing sealing shoulder in the fluid chamber to seat the uphole valve when the upper restriction slides relatively upward over at least an initial portion of the uphole valve, the uphole valve having a first exterior surface that fits with close tolerance within the uphole restriction over at least a portion of the first exterior surface;

a first bypass, defined by at least one of the uphole valve, the outer housing, and the inner mandrel, is exposed when the first seating surface unseats from the downhole facing sealing shoulder;

a downhole valve disposed within the fluid chamber, the downhole valve having a second seating surface engageable with an uphole facing sealing shoulder in the fluid chamber to seat the downhole valve when the downhole restriction slides relatively downward over at least an initial portion of the downhole valve, the downhole valve having a second exterior surface that fits with close tolerance within the downhole restriction over at least a portion of the second exterior surface;

a second bypass, defined by at least one of the downhole valve, the outer housing, and the inner mandrel, is exposed when the second seating surface unseats from the uphole facing sealing shoulder;

first jarring surfaces on the inner mandrel and outer housing respectively for jarring contact with each other during a jar in a first direction; and second jarring surfaces on the inner mandrel and outer housing respectively for jarring contact with each other during a jar in a second direction;

the uphole restriction and downhole restriction being separated such that when the downhole restriction slides relatively downward over the initial portion of the downhole valve to seat the downhole valve, at least a portion of the uphole restriction extends downwardly beyond an uphole end of the uphole valve sufficient to allow a jar in the first direction to be carried out, and when the uphole restriction slides relatively upward over the initial portion of the uphole valve to seat the uphole valve, at least a portion of the downhole restriction extends upwardly beyond a downhole end of the downhole valve sufficient to allow a jar in the second direction to be carried out.

30. The double-acting jar of claim 29 further comprising a first bypass channel defined by at least one of the uphole valve and the uphole restriction to allow bypass of fluid from a downhole end of the uphole valve to the first exterior surface as the uphole restriction slides relatively upward over the initial portion of the uphole valve.

31. The double-acting jar of claim 29, further comprising a second bypass channel defined by at least one of the downhole valve and the downhole restriction to allow bypass of fluid from an uphole end of the downhole valve to the second exterior surface as the downhole restriction slides relatively downward over the initial portion of the downhole valve.

* * * * *